US006106347A

United States Patent [19]

Harness

[11] Patent Number: 6,106,347

[45] Date of Patent: Aug. 22, 2000

[54] GUIDANCE PAD FOR SURFBOARD ATTACHMENT

[76] Inventor: Greg L. Harness, c/o Ultra Channels Inc, 17 28th Ave, #204, Venice, Calif. 90291

[21] Appl. No.: 09/215,929

[22] Filed: Dec. 18, 1998

[51] Int. Cl.[7] ..... B63B 1/00

[52] U.S. Cl. ..... 441/79; 441/68; 441/74

[58] Field of Search ..... 441/74, 79, 68; 114/126, 141, 152, 274, 357

[56] References Cited

U.S. PATENT DOCUMENTS 5,934,961 8/1999 Mehrmann et al. ..... 441/65

*Primary Examiner*—S. Joseph Morano
*Assistant Examiner*—Andrew D. Wright
*Attorney, Agent, or Firm*—J. E. McTaggart

[57] ABSTRACT

A guidance pad, made from flexible plastic material and configured with an array of parallel guidance ridges on the bottom side, can be retrofitted onto the bottom side of an aquatic sports device such as a surfboard so that the ridges, running fore-and-aft, enhance lateral stability by guiding water flow through the channels formed between the ridges. In a preferred embodiment, five equally-spaced ridges having a V-shaped cross-section are molded integrally on the bottom side of a generally rectangular thin flexible pad whose flat top surface is provided with a layer of self-adhesive material retained by a peel-off backing. To install the guidance pad, the backing is peeled off to expose the adhesive material and the top surface of the pad is attached onto the bottom of the surfboard just forward of the fin, for which a cutaway region is provided at the aft edge of the pad. The hydro-dynamic effects, e.g. lateral resistance, provided by the plural shallow ridges of the guidance pad of this invention combine synergistically with the hydro-dynamic effects of the deeper, shorter fixed fin(s) and overall streamlined profile to provide the surfer with enhanced overall surfing performance, including greater control and maneuverability, and faster response time on turns.

18 Claims, 2 Drawing Sheets

FIG. 1A
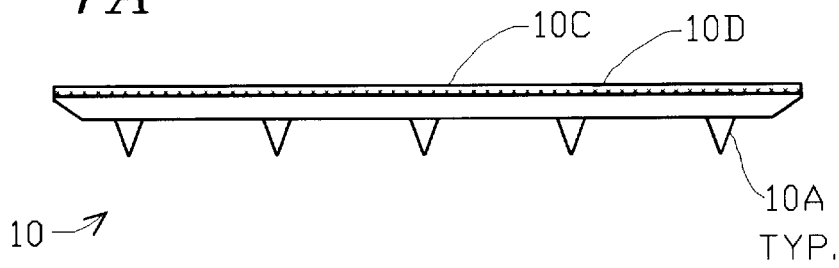
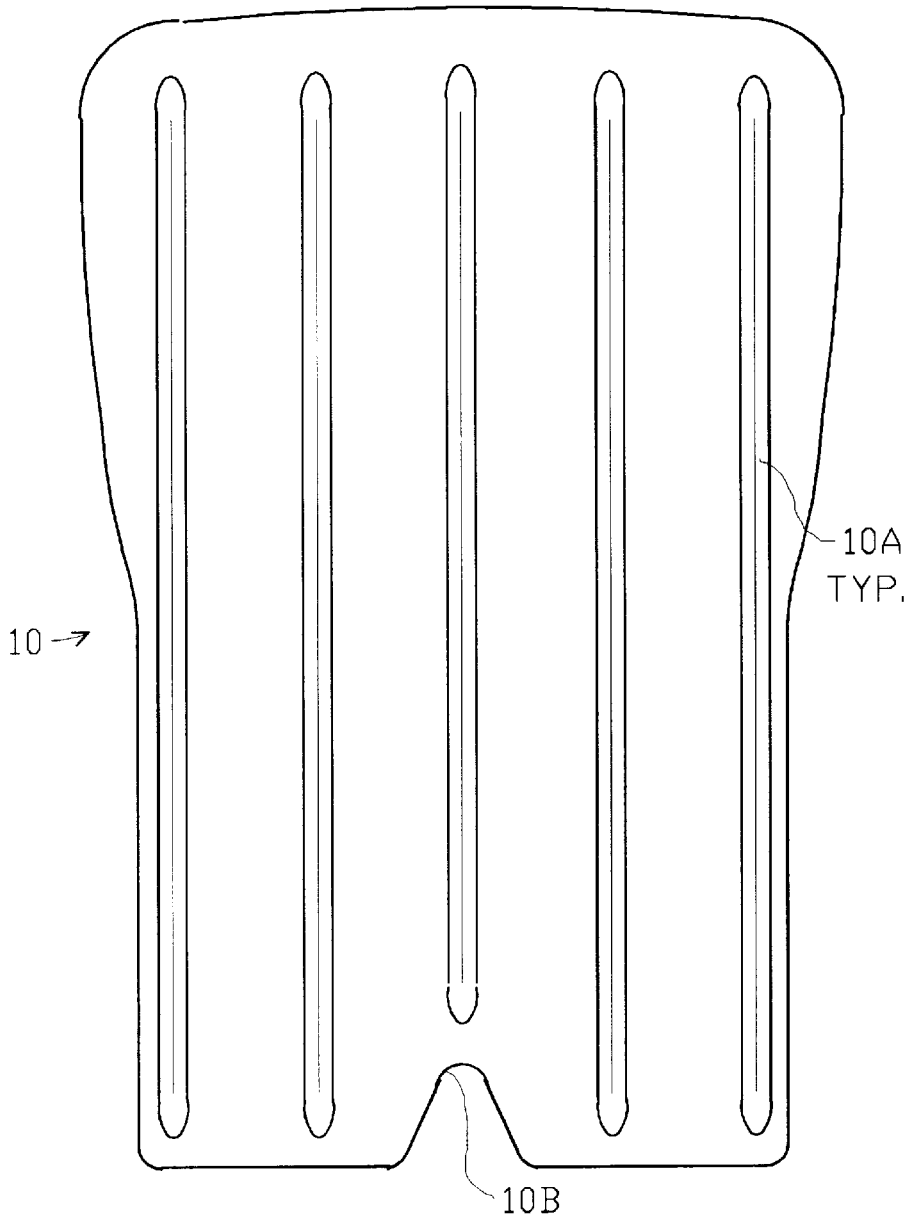
FIG. 1

GUIDANCE PAD FOR SURFBOARD ATTACHMENT

FIELD OF THE INVENTION

The present invention relates to the field of aquatic sports equipment, and more particularly it relates to a hydrodynamic device that can be retrofitted onto the bottom surface of an existing surfboard to provide longitudinal ridges to enhance its performance with regard to lateral stability.

BACKGROUND OF THE INVENTION

Surfboards are commonly equipped with one or more short, deep, dagger-shaped fins extending downwardly at or near the rear of the board. Such a fin acts as a fixed rudder that depends on the surfer shifting body weight via the legs and their location on the board, for maneuvering and turning. The hydrodynamics involved are extremely complex and ever-changing to the extent that quantitative analysis is practically impossible, therefore the general configuration of present day surfboards is the result of a highly empirical evolution in a quest for perfection that continues on into the future. The arbitrary fixed location of the fin(s) so far to the rear leaves the main portion of the surfboard's smooth bottom subject to side-slip due to the lack of lateral resistance forward of the fin. This can detract from ultimate performance, e.g. slow down the response time on turns due to side-slip in the water, i.e. insufficient "bite".

Amongst known approaches to improve over the simple finned surfboard configuration, there have been attempts to provide additional lateral resistance in the stern region of a surfboard forward of the fin(s) by configuring the bottom of the surfboard with longitudinal channels as an integral part of the surfboard in a manner sometimes found in sailboat and powerboat hulls; however such structure has not become popular in surfboards due to the added manufacturing cost and complexity along with reliability problems since the channel regions proved less robust than a continuously smooth bottom surface, frequently cracking and causing damage to the surfboard. Consequently the great majority of surfboards in general use are configured with a smooth bottom surface and one or more fins located far aft.

In an alternative approach, a group of strips or ridges for enhancing lateral resistance can be individually attached onto an existing surfboard as a retrofit. Depending on the rigidity of the material in the strips and the narrowness of the area available for adhesive attachment, the adhesive layer will generally be subjected to such extremely high stress concentrations that both the adhesive material itself and the craftsmanship of application would be unusually critical and demanding, such that in practice there could be a high risk of unreliability and failure, especially when each strip must be separately attached to the surfboard by the user. Many users may lack the necessary expertise and skills required to apply the critical adhesive properly to each of the strips, and to perform the numerous difficult measurements required on the surfboard in order to get all of the strips accurately located and parallel to each other.

DISCUSSION OF RELATED KNOWN ART

U.S. design Pat. No. 323,691 to Olson illustrates the approach of configuring grooves into the bottom of a surfboard as an integral part thereof, as described above.

U.S. Pat. No. 4,878,980 to Stedman exemplifies the approach of retrofitting a surfboard with a group of metal molding strips that were originally designed and intended for automotive purposes, marketed under the name Power Ridges, to be adhesively attached to the bottom of a surfboard.

OBJECTS OF THE INVENTION

It is a primary object of the present invention to provide a single add-on device for attachment onto the bottom of a surfboard to increase the lateral resistance forward of the fin(s).

It is a further object that the add-on device provide a plurality of parallel ridges defining channels between the ridges that will act as water guides.

It is a further object to provide such ridges as integral parts of a device that is to be adhesively attached to a bottom surface of a surfboard and that provides an area for adhesive attachment that exceeds the footprint area of the ridges themselves by several orders of magnitude so to ensure adhesive reliability.

It is a further object to provide a guidance pad with such ridges as an integral flexible device with a large adhesive attachment area that can be easily attached to the bottom of a surfboard and that will perform in a reliable manner.

SUMMARY OF THE INVENTION

The abovementioned objects have been accomplished by the present invention of a flexible plastic guidance pad configured with an array of integral parallel longitudinal ridges on the bottom side, and having a smooth top side which is coated with adhesive material retained by a peel-off backing. The pad is easily attached to the bottom of the surfboard just forward of the fin after peeling off the backing to expose the adhesive material.

A preferred embodiment is made generally rectangular and formed integrally with five equally-spaced ridges of triangular cross-section; a V-shaped area is cut away centrally at the aft edge so to straddle a central fin of the surfboard.

The hydro-dynamic effects accomplished by the present invention, including the added lateral resistance, provided by the plural shallow ridges of the guidance pad combine synergistically with the hydro-dynamic effects of the deeper, shorter fixed fin(s) to provide the surfer with enhanced performance overall, including greater control and maneuverability, and faster response time on turns.

BRIEF DESCRIPTION OF THE DRAWINGS

The above and further objects, features and advantages of the present invention will be more fully understood from the following description taken with the accompanying drawings in which:

FIG. 1 is a bottom view of a surfboard guidance pad of the present invention, showing five longitudinal ridges.

FIG. 1A a rear front of the guidance pad of FIG. 1, showing the shape of the ridges.

DETAILED DESCRIPTION

Figure 2:
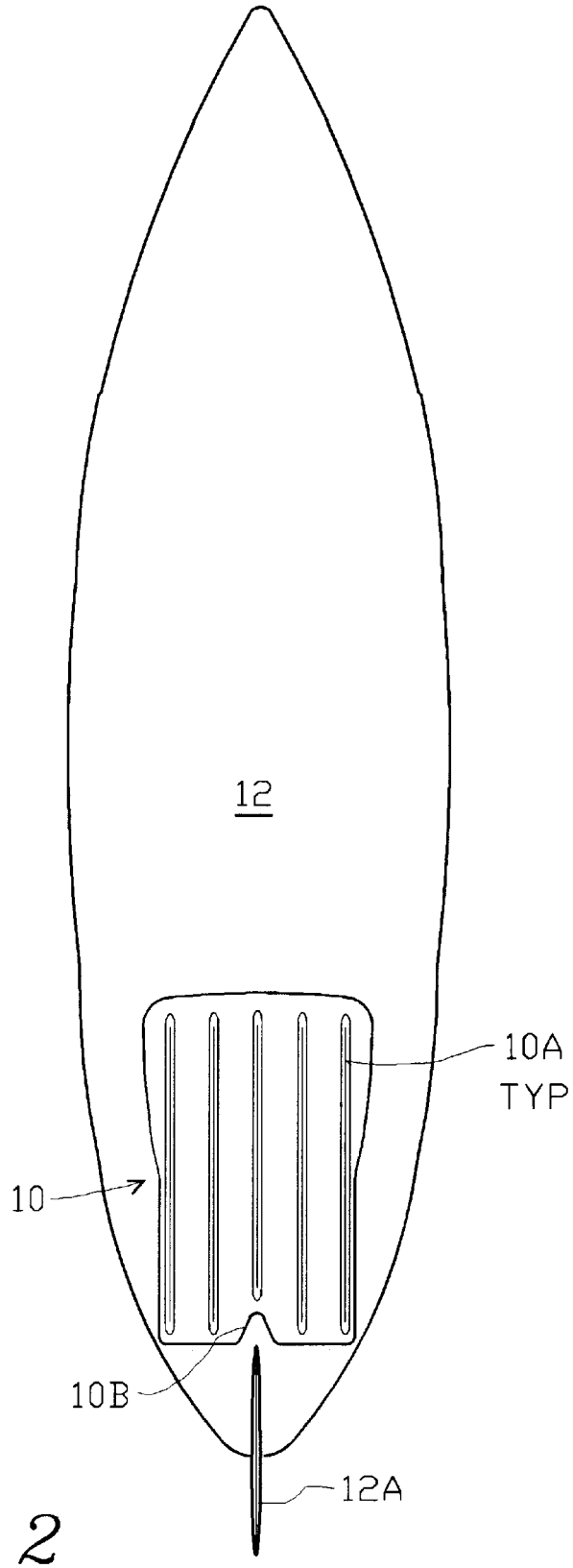
FIG. 2 is a bottom view of a surfboard retrofitted with the guidance pad of FIGS. 1 and 1A.

FIG. 1 is a bottom view of a surfboard guidance pad 10 of the present invention, molded from flexible plastic material to provide five integral longitudinal ridges 10A as shown. The rear edge is configured with a central V-shaped cutout 10B and the forward portion is flared to an increased width. Typically the guidance pad 10 is made about 18 inches long by width that ranges from 11 inches forward to 9 inches aft.

FIG. 1A a front view of the surfboard guidance pad 10 of FIG. 1, showing the ridges 10A to have a V-shaped cross-section, and showing the topside location of the adhesive layer 10C and protective peel-off backing 10D. With suitable material such as vinyl or silicon elastomer, the guidance pad can be made quite thin, typically 0.017 inches, and feathered to a sharp edge all around to blend smoothly with the surfboard and thus minimize water drag. The ridges 10A are typically made to be ½ inch deep by ½ inch wide.

FIG. 2 is a bottom view of a surfboard 12 retrofitted with the guidance pad 10 of FIGS. 1 and 1A, adhesively fastened in place against the bottom of surfboard 12 in an aft region thereof just forward of the fin 12A, which is straddled by the V-shaped cutout 10B. The 9" width in this region will usually fit between the forward fins in a surfboard with three fins.

The spaces between the five ridges 10A form four channels each about 1⅝ inches wide, which channel the flow of water while resisting side-slip, thus enhancing the surfboard's performance and maneuverablity.

As an alternative to the use of peel-off adhesive backing, suitable adhesive material could be utilized applied to the top surface of guidance pad 12 and/or the corresponding area on the bottom surface of the surfboard 12 at the time of installation.

In general, the adhesive material is selected to provide the strongest and most permanent bond possible; however a different class of adhesive could be selected with the objective of facilitating subsequent removal and possible repeated installation and de-installation.

There exists also an alternative of making the guidance pad from a suitable material such as fiberglass and bonding the material integrally to the surfboard material with thermosetting plastic, resins or the like, either in original manufacture or as an aftermarket modification.

The invention may be also practiced with other outline shapes of the guidance pad 12, other cross-sectional shapes and spacings of the ridges 10A and with more or less than the quantity of five ridges 10A shown as an illustrative embodiment.

The generally V-shaped cross-section of ridges 10A could be modified by slight rounding at the bottom, and/or by making the two sides curved (convex or concave) rather than flat as shown.

As an alternative to molding guidance pad 12 complete with integrally formed ridges 10A, the main body of the pad could be of flat material and the ridges 10A fabricated separately and attached by known adhesive or other attachment means.

The invention may be embodied and practiced in other specific forms without departing from the spirit and essential characteristics thereof. The present embodiments are therefore to be considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A guidance pad for underside attachment to an aquatic sports device such as a surfboard for enhancing lateral resistance and control of the device while under way in water, said guidance pad comprising;

a flexible main pad portion having a substantially flat upper surface made and arranged to be fastened adhesively to an underside surface region of the aquatic sports device in a generally aft region thereof; and a plurality of parallel ridges, formed in an integral manner with said main pad portion, running in a fore-and-aft direction and extending downwardly from a bottom side thereof, each of said parallel ridges being shaped with a taper at each end in a manner to be substantially streamlined with respect to longitudinal liquid flow.

2. The guidance pad as defined in claim 1 wherein said main pad portion is made to be generally rectangular in shape.

3. The guidance pad as defined in claim 1 wherein said parallel ridges are separated by a substantially uniform distance.

4. The guidance pad as defined in claim 1 wherein said parallel ridges are configured with a cross-section that is generally V-shaped.

5. The guidance pad as defined in claim 1 wherein said parallel ridges are configured with a cross-section that is V-shaped with a pair of symmetrical flat sides.

6. The guidance pad as defined in claim 1 further comprising:

a layer of adhesive material applied onto the upper surface of said guidance pad; and a protective backing layer over said layer of adhesive material, made and arranged to be peeled off for deployment and adhesive attachment of said guidance pad onto the underside surface region of the aquatic sports device.

7. The guidance pad as defined in claim 1 wherein said main pad portion is made and arranged to have a forward region that is generally wider than the aft region.

8. The guidance pad as defined in claim 3, wherein the aquatic sports device is configured with a tail fin and wherein said main pad portion is configured and arranged to have in a trailing edge thereof, a V-shaped central recessed region provided for clearance around the tail fin of the aquatic sports device.

9. The guidance pad as defined in claim 3, comprising a quantity of five of said parallel ridges, each extending at least 85% of the length of said main pad portion.

10. The guidance pad as defined in claim 1 wherein said main pad portion is made and arranged to taper to a feathered edge all around in a border region so as to minimize water drag, and to have substantially uniform thickness in all other regions.

11. The guidance pad as defined in claim 10 wherein the thickness of said main pad portion is made to be in the order of 0.017 inches.

12. A guidance pad for underside attachment to an aquatic sports device such as a surfboard for enhancing lateral resistance and control of the device while under way in a liquid medium such as water, said guidance pad comprising;

a flexible, generally rectangular main pad portion having a substantially flat upper surface made and arranged to be fastened adhesively to an underside surface region of the aquatic sports device in a generally aft region thereof, and having a substantially flat lower surface; and a plurality of parallel ridge pieces securely attached to said lower surface, running in a fore-and-aft direction, and extending downwardly from the flat lower surface of said main pad portion, said ridge pieces being made and arranged to provide lateral resistance to water flow under the aquatic sports device, each of said parallel ridges being shaped with a taper at each end in a manner to be substantially streamlined with respect to longitudinal liquid flow.

13. A guidance pad for deployment on an underside surface region of a surfboard in a generally aft region thereof, for enhancing lateral resistance and control of the surfboard while under way in water, said guidance pad comprising;

a flexible, generally rectangular main pad portion, having a substantially flat upper surface, and having a substantially uniform thickness tapering to a feathered edge all around in a border region so as to provide a streamlined overall shape when the guidance pad is deployed on the surfboard;

a plurality of uniformly-separated parallel ridges formed in an integral manner with said main pad portion, running in a fore-and-aft direction and extending downwardly from a bottom surface thereof so as to provide resistance to lateral water flow, said parallel ridges being configured to have a generally V-shaped cross-section and to have a tapered shape at each end so as to provide a streamlined shape with regard to longitudinal water flow;

a layer of adhesive material applied onto the upper surface of said guidance pad; and a protective backing layer covering said layer of adhesive material, made and arranged to be peeled off for deployment and adhesive attachment of said guidance pad onto the underside surface region of the surfboard.

14. The guidance pad as defined in claim 13 wherein said main pad portion is configured to be substantially elongate and to have increased width in a forward region thereof.

15. The guidance pad as defined in claim 13, comprising a quantity of five of said parallel ridges, each extending at least 85% of the length of said main pad portion.

16. The guidance pad as defined in claim 15 wherein said main pad portion is made about 0.017 inches thick, about 18 inches long, and ranging in width from about 11 inches forward to about 9 inches aft, and wherein each of said ridges is dimensioned to extend downwardly about ½ inch and to have an upper width of about ½ inch, being spaced apart to form four channels each about 1⅝ inches wide.

17. The guidance pad as defined in claim 13, wherein said main pad portion is configured to be substanially elongate and to have, in a trailing edge thereof, a V-shaped central recessed region that provides clearance around a tail fin of the surfboard.

18. The guidance pad as defined in claim 17, comprising a quantity of five of said parallel ridges including two pairs thereof, all of equal length, flanking a central ridge that is foreshortened in correspondence with the V-shaped central recessed region in the trailing edge.

* * * * *